US005435038A

United States Patent [19]

Sauers

[11] Patent Number: 5,435,038

[45] Date of Patent: Jul. 25, 1995

[54] BRUSH ROLLER ASSEMBLY FOR VACUUM CLEANER SWEEPER

[76] Inventor: Carl B. Sauers, 276-21st St. NW., Barberton, Ohio 44203

[21] Appl. No.: 209,430

[22] Filed: Mar. 10, 1994

[51] Int. Cl.[6] ..... A46B 13/02

[52] U.S. Cl. ..... 15/182; 15/41.1; 15/179; 15/391; 15/392; 384/489; 492/29; 492/47

[58] Field of Search ..... 15/41.1, 42–48, 15/48.1, 48.2, 179–183, 383, 384, 389, 391, 392; 384/489; 492/29, 47

[56] References Cited

U.S. PATENT DOCUMENTS

| | | | |
|---|---|---|---|
| 1,286,321 | 12/1918 | Hoover . | |
| 1,582,652 | 4/1926 | Albrecht . | |
| 1,681,453 | 8/1928 | Wright . | |
| 1,815,084 | 7/1931 | White | 15/179 |
| 1,836,512 | 12/1931 | Smith | 15/41.1 |
| 1,972,796 | 9/1934 | Schaad . | |
| 1,999,696 | 4/1935 | Kitto . | |
| 2,176,769 | 10/1939 | Martinet | 15/392 |
| 2,226,581 | 12/1940 | Richardson | 15/41.1 |
| 2,263,762 | 11/1941 | Dow et al. | 15/392 |
| 2,602,175 | 7/1952 | Thiele | 15/41.1 |
| 2,712,669 | 7/1955 | Frere et al. | 15/183 |
| 3,284,830 | 11/1966 | Kroll . | |
| 3,846,865 | 11/1974 | Holman | 15/392 |
| 3,879,786 | 4/1975 | Larkin . | |
| 4,173,807 | 11/1979 | Maier | 15/179 |
| 4,209,872 | 7/1980 | Maier | 15/179 |
| 4,403,372 | 9/1983 | Keane et al. | 15/339 |
| 4,429,430 | 2/1984 | Lyman | 15/182 |
| 5,134,744 | 8/1992 | Ji | 15/179 |
| 5,193,243 | 3/1993 | Stegens | 15/179 |
| 5,249,328 | 10/1993 | Shin | 15/392 |
| 5,272,785 | 12/1993 | Stegens | 15/179 |

FOREIGN PATENT DOCUMENTS

| | | | |
|---|---|---|---|
| 225673 | 12/1959 | Australia | 15/179 |
| 3342833 | 6/1985 | Germany | 15/41.1 |
| 4-180721 | 6/1992 | Japan | 15/383 |
| 474619 | 11/1937 | United Kingdom | 15/41.1 |
| 2086717 | 5/1982 | United Kingdom . | |

*Primary Examiner*—Mark Spisich
*Attorney, Agent, or Firm*—Oldam, Oldam, & Wilson Co.

[57] ABSTRACT

A roller assembly comprises an essentially cylindrical spindle which is rotatably supported at opposite ends by a pair of end assemblies. The spindle has brush elements on a circumferential surface and axial bores extending inwardly from each of the ends. Each end assembly comprises a shoulderless cylindrical stub shaft which is coaxial with and rotatable with the spindle, a bearing frictionally mounted on an outer end of the stub shaft, and a non-rotating end cap which may be mounted in a vacuum cleaner chassis member, such as two opposite side walls of a vacuum cleaner nozzle. The stub shaft comprises along its axial length a smooth inboard portion, a roughened middle portion which frictionally engages a bore wall, and a smooth outboard portion which extends beyond the end of a spindle. The bearing is mounted on this outboard portion. The end assembly may also include a thread guard and a washer which rotate with the spindle. An annular shoulder surrounding the open outer end of the bore positions the bearing. The end cap may have an axially inwardly extending flange which forms a receptacle for the bearing, and the spindle may have a counterbore extending axially inwardly from each end to provide a recess for the bearing and this flange. The roller assembly can be readily built to close tolerances in overall length, bore depth, and stub shaft diameter, and with a high degree of concentricity, thereby minimizing both bearing wear and vibration.

11 Claims, 2 Drawing Sheets

BRUSH ROLLER ASSEMBLY FOR VACUUM CLEANER SWEEPER

TECHNICAL FIELD

This invention relates to brush roller assemblies for vacuum cleaner sweepers.

BACKGROUND ART

Brush roller assemblies for vacuum cleaner sweepers are well-known. Such assemblies have been described in numerous references, including a number of United States patents. Basically, a brush roller assembly comprises a rotatably mounted and motor-driven spindle having a brush on a cylindrical surface thereof, and a mounting structure at each end of the spindle r rotatably mounting the same so that the spindle can rotate relative to fixed side walls of a vacuum cleaner nozzle housing. Mounting structures vary considerably. One type of mounting structure known in the art comprises end assemblies at each end of the spindle, wherein each end assembly includes a rotatable stub shaft, a bearing, and an end cap member which is fixedly secured to the vacuum cleaner housing. Structures of this type are shown, for example, in U.S. Pat. Nos. 3,879,786, 4,403,372, 5,193,243 and 5,272,785. Another type of roller assembly for a vacuum cleaner sweeper comprises a supporting shaft which extends across a vacuum cleaner nozzle and is non-rotatably mounted in suitable supports at the nozzle side walls, and a spindle which is rotatably mounted on the shaft. Such structure is illustrated, for example, in U.S. Pat. No. 1,999,696 and in published British patent application GB 2 086 717 A.

Certain problems have been associated with vacuum cleaner roller assemblies which are known in the art. One problem is vibration. The problem of vibration is exacerbated by current developments in vacuum cleaner sweepers. Both the length and the diameter of the roller of a vacuum cleaner sweeper are increasing as new vacuum cleaner structures are developed. The speed (rpm) at which the brush is driven is also being increased. On the other hand, the total weight of the vacuum cleaner sweeper, including the chassis, becomes less and less as developments take place. These developments in the industry lead to more and more vibration.

SUMMARY OF THE INVENTION

The present invention provides a brush roller structure for vacuum cleaners which can be manufactured reliably to close dimensional tolerances and with a high degree of concentricity of all rotatable parts, thereby minimizing the tendency to vibration and virtually eliminating any tendency of the roller to bind.

The present invention provides a brush roller assembly comprising an essentially cylindrical spindle having a central axis and a pair of coaxial end assemblies for rotatably mounting the spindle at opposite ends thereof. The spindle includes an axial bore of predetermined depth extending inwardly from each end. This bore has a closed inner end and an open outer end and comprises a cylindrical side wall and a transverse end wall at the inner end.

The two end assemblies are preferably identical and each end assembly comprises: (1) an essentially cylindrical rotatable shoulderless stub shaft comprising a smooth cylindrical inboard portion which is received in the bore, a toughened middle portion which frictionally grips the bore so that the shaft and the spindle rotate together, and a smooth cylindrical outboard portion which extends axially outwardly beyond the bore, the stub shaft having a first end which abuts the inner end of the bore; (2) a bearing mounted on the outboard portion of the shaft, and (3) a non-rotating end cap comprising a transversely extending end plate having inner and outer surfaces and a flange extending axially inwardly therefrom and surrounding the bearing. This end cap is adapted to be fixedly mounted on a chassis member, such as the side walls of the nozzle housing, of a vacuum cleaner sweeper. Brush roller further includes an annular shoulder surrounding the open outer end of the bore, and is adapted to receive and position a bearing.

The spindle has a beater element, typically brush bristles, mounted on its surface. The spindle is adapted to be driven by a motor through a drive belt.

The brush roller assembly of this invention can be manufactured to close tolerances, including a tolerance in overall length which is typically ±0.015". This markedly reduces the tendency to vibration.

DESCRIPTION OF THE PREFERRED EMBODIMENTS

This invention will now be described in detail with reference to preferred embodiments thereof.

FIGS. 1–4 illustrate in detail a first and preferred embodiment of this invention.

Figure 1:
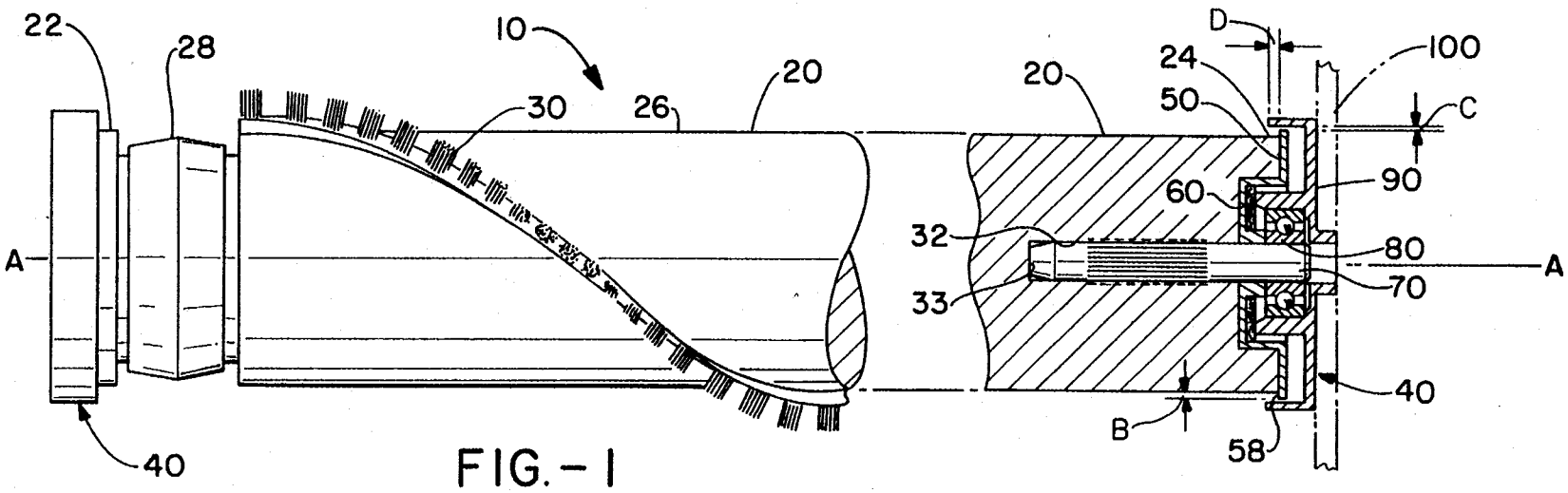
FIG. 1 is a front elevational view, with parts shown in section, of a brush roller assembly for a vacuum cleaner sweeper according to this invention.
Figure 2:
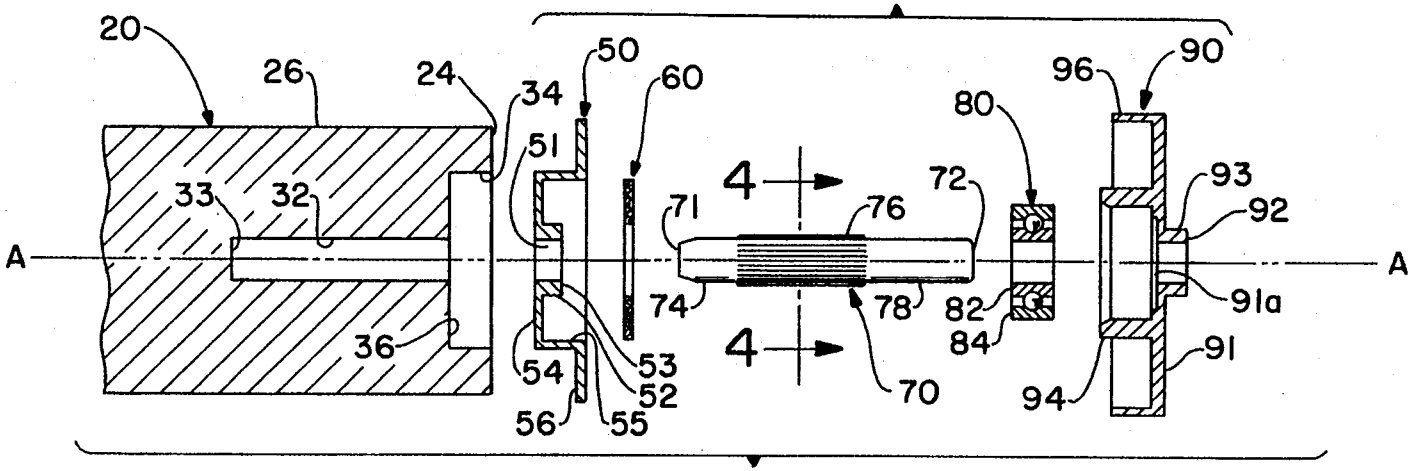
FIG. 2 is an exploded fragmentary longitudinal sectional view (with a portion of the spindle omitted) of the structure shown in FIG. 1.

Referring now particularly to FIGS. 1 and 2, 10 is a brush roller assembly as a whole according to a first and preferred embodiment of this invention. Brush roller assembly 10 comprises an essentially cylindrical spindle 20 having a central axis A, and a pair of end assemblies 40 for rotatably supporting the spindle 20 at opposite ends thereof.

There are two end assemblies 40, one at each end of spindle 20. They are preferably identical and so only one is shown in detail. Each end assembly comprises a thread guard 50, a felt washer 60 (which is optional), a stub shaft 70, and a bearing 80, all of which rotate with spindle 20; and a non-rotating end cap 90, which is adapted to be fixedly mounted in a vacuum cleaner sweeper chassis member 100 (shown in phantom). Typically the vacuum cleaner sweeper chassis member 100 in which the end assemblies 40 are mounted comprises spaced side walls of a housing for a vacuum cleaner nozzle.

Spindle 20 is a solid structure which is preferably made of wood but which can be made of other essentially rigid, hard solid materials, including hard rubber and molded plastic. The spindle 20 can be made of metal (steel, for example) but ordinarily is not metallic for reasons of cost. The spindle should be solid and not hollow.

Spindle 20 is essentially cylindrical and has a central axis A, first and second ends 22, 24, respectively, and a cylindrical circumferential surface 26 extending from one end to the other. Spindle 20 has a uniform outside diameter over its entire length. The diameter of spindle 20 is not critical and may vary, for example, from about 1.0 to about 2.0 inches. Spindle 20 is motor-driven through a drive belt, and to that end has a belt pulley 28 for receiving a drive belt. The belt pulley 28 is preferably located near one end or the other of the spindle, but may be located near the center if desired. A beating or brushing element 30, typically comprising a plurality of tufted bristles arranged in a helical pattern, is provided on the cylindrical surface 26 of spindle 20.

Extending inwardly along central axis A from each end of spindle 20 is a cylindrical bore 32 of predetermined depth. Each bore is axially aligned with central axis A. Each bore is closed at its inner end and open at its outer end, and comprises an inner end wall 33 and a cylindrical side wall. The diameter of bore 32 is typically about 0.25 inch, but may be larger or smaller if desired. Whatever diameter is selected, the tolerance of bore diameter is ±0.001 inch. The depth of bore 32 is typically about 1.5 inch, but may be greater or smaller (say from about 1.0 inch to about 2.0 inches), with a tolerance in bore depth of about ±0.005 inch. Also extending inwardly from each end of spindle 20 is a counterbore 34, which is of greater diameter and shorter axial length than bore 32. Counterbore 34 forms a recess in an end (22 or 24) of spindle 20 and includes a cylindrical side wall and a flat annular inner end wall surface 36. The outer end of the counterbore is open. Counterbore 34 forms a recess for thread guard. 50, and bearing 80, and a portion (a flange) of end cap 90.

The vacuum cleaner sweeper in which the roller assembly of the present invention is mounted may be a conventional upright vacuum cleaner sweeper suitable for home use. The spindle 20 extends transversely, i.e., perpendicular to the direction of forward and back motion of the vacuum cleaner sweeper when in use. The width of the nozzle portion of the vacuum cleaner sweeper (typically about 12 inches to about 16 inches, although this is not critical) determines the length of the brush roller 10 of this invention.

Thread guard 50 comprises, from its central axis A outwardly, a central opening 51 of the same diameter as bore 32, an axially outwardly directed central boss 52 which surrounds central opening 51 and terminates in shoulder 53, an annular and flat central web 54, a cylindrical wall 55 which extends axially outwardly from central web 54, and an annular flat outer portion 56 which extends radially outwardly from cylindrical wall 55. The outer circumference of outer portion 56 is circular. The central web 54 and the outer portion 56 are axially offset. The thread guard 50 is of slightly greater diameter than the spindle 20, so that at the circumference of the outer portion 56 there is a lip 58 which extends radially beyond the circumferential surface 26 of spindle 20. The width of this lip is denoted as B. This lip 58 provides a barrier to prevent threads from running off the end of the spindle 20 and reaching the bearing 80. The central web portion 54 of thread guard 50 rests against the inner surface 36 of the counterbore 34, and the outer portion 56 of the thread guard 50 rests against an outer end surface 22 or 24 of spindle 20. Shoulder 53 provides a support surface for bearing 80.

An annular washer 60, which is preferably made of felt, may be placed on the outer surface of the central web 54 of thread guard 50. This washer, although not essential, is helpful in preventing dust from reaching the bearing 80. Both the central web 54 and washer 60 are received in a recess formed by counterbore 34.

Figure 4:
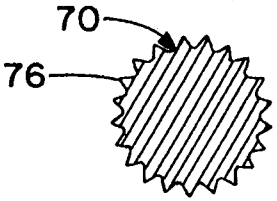
FIG. 4 is a cross-sectional view, on a greatly enlarged scale, taken along line 4—4 of FIG. 2.

Stub shaft 70 is essentially cylindrical (i.e., of essentially uniform diameter over its entire length) and is made of ground steel. Stub shaft 70 comprises an inner (or first) end 71 and an outer (or second) end 72 and comprises, from one end to the other, a smooth cylindrical inboard portion 74, a roughened (splined or knurled) middle portion 76, and a smooth cylindrical outboard portion 78. The outboard portion 78 extends axially outwardly beyond the outer end of bore 32. The length of stub shaft 70 may be proportioned to the overall length of the roller 10 as a whole, and is ordinarily from about 1.5 to about 2 inches. The diameter is typically about 0.25 inches. The two smooth portions 74 and 78 typically have the same diameter, which is just slightly smaller than the diameter of bore 32. The knurled center portion 76 has a plurality of essentially V-shaped longitudinally extending ribs or splines. The outer diameter of the shaft, measured in this roughened portion, is just very slightly larger than the diameter of bore 32, so that the shaft will frictionally engage the bore. This is best seen in FIG. 4. Also, the stub shafts 70 are made of a metallic material, preferably ground steel, for hardness and strength, while the spindle 20 is typically made of wood and in any case is made of a material which is softer than the stub shaft material. Since the stub shafts 70 are made of a harder material than the spindle 20 and the outer diameter at the roughened portion is slightly larger than the diameter of bore 32, an excellent friction fit between the stub shafts and the spindle is obtained when the stub shafts are inserted into position. This enables the stub shafts 70 and the spindle 20 to co-rotate as a unit without slippage. Each stub shaft 70 is inserted into bore 32 so that the inner end 71 of the stub shaft is in contact with the inner end 33 of the bore 32.

Both the length and the diameter, especially the diameter of the stub shaft 70 are manufactured to very close tolerances. Deviation from nominal or design diameter should not exceed about 0.0003".

A shoulderless stub shaft 70 (i.e., one that has no shoulder or collar) is very important. It is difficult to manufacture a stub shaft with a shoulder that is precisely perpendicular to the axis of the shaft at reasonable cost. When a shoulder on a stub shaft serves as an abutment surface for a bearing, there is a tendency for the stub shaft and the bearing not to be precisely axially aligned with the central axis of the spindle. In that case vibration of the roller 10 when it rotates at high speed is likely to result. The present stub shaft, being shoulderless and made of ground metal (as opposed to cold-headed metal) to extremely close dimensional tolerances as noted, results in a stub shaft having a high degree of concentricity denoting the fact that there is little if any variation between the central axis A of the stub shaft and the central axis A of the spindle 20 and the roller assembly 10 as a whole. This assures a substantially vibration-free operation.

A bearing 80 having a rotatable inner race 82 and a stationary outer race 84 is mounted via friction fit on the outboard portion 78 of stub shaft 70. This bearing may be a conventional bearing (e.g., a ball bearing) of generally annular shape, having a cylindrical inner wall whose diameter is essentially the same as that of the outboard portion 78 of stub shaft 70 (i.e., actually just enough larger so as to permit assembly of the bearing on the outboard portion 78 of the stub shaft while being tight enough so that it is frictionally retained in position). Bearing 80 also has a cylindrical outer wall. While a close tolerance between the inside diameter of the bearing 80 and the diameter of the outboard portion of stub shaft 78 of stub shaft 70 is necessary in order to achieve this result, it has been found that the desired result can be achieved with a relatively inexpensive bearing; a high-precision bearing is not necessary. Bearing 80 is supported by shoulder 53 in the assembled device as shown in FIG. 1. By assembling bearing 80 on a smooth portion (i.e., outboard portion 78) of stub shaft 70 rather than a knurled portion (e.g., middle portion 76) a more precise alignment can be obtained. Also, by providing a shoulder on a member (in this case thread guard 50) which is firmly positioned against an end of a spindle (20), or (in the embodiment of FIGS. 5–7) on the spindle itself, rather than on a stub shaft, one obtains a roller assembly structure in which concentricity is easily achieved and maintained. The roller assembly of this invention withstands both axial and radial stresses (the latter primarily from forces transmitted by the brush to the spindle due to contact between the brush and the surface being swept) which tend to cause non-concentric alignment of the spindle and the stub shafts.

Finally, a roller assembly 10 of this invention comprises an end cap 90, which is adapted to be fixedly mounted in a vacuum cleaner chassis member 100 (shown in phantom lines in FIG. 1) and in particular in two opposite side walls of the nozzle portion of a vacuum cleaner. The chassis members 100 may each include a slot 102 for receiving and frictionally engaging an end cap 90.

End cap 90 comprises a radially extending end plate 91 which has a central opening and an outer circumferential edge, both of which are circular in shape. End plate 91 has inner and outer surfaces (unnumbered); the outer surface is flat; a portion of the inner surface is cut away at 91*a* so that the end cap 90 (which is stationary) will not rub against the rotatable inner race 82 of bearing 80. The central opening (which is not essential) may have the same diameter as that of the outboard portion 78 of stub shaft 70. Surrounding the central opening is an axially outwardly directed boss 92, which includes a pair of opposite flat sides 93, which are adapted to frictionally engage the slot 102 in the vacuum cleaner chassis members (e.g., nozzle side walls) 100.

End cap 90 further comprises a first annular flange 94 and a second annular flange 96. Both flanges extend axially inwardly from end plate 91. Flange 94 extends into the recess formed by counterbore 34. The purpose of the first flange 94 is to provide a well or receptacle for receiving the bearing 80. To this end the inner diameter of first flange 94 is essentially the same as the outer diameter of bearing 80. The axial length of the first flange 94 is preferably just slightly longer than the axial length of the bearing 80. First flange 94 has an annular forward edge which loosely contacts washer 60 as shown in FIG. 1, to prevent dust from reaching bearing 80. (When washer is omitted, a space will nevertheless remain between the non-rotating flange 94 and the rotating thread guard 50).

The second flange 96 extends axially inwardly from the circumferential edge of the end plate 91. End plate 91 is of slightly greater diameter than either spindle 20 or thread guard 50. The outside diameter of second flange 96 is preferably the same as the outside diameter of end plate 91; the inside diameter of second flange 96 is just slightly larger than the diameter of thread guard 50, so that there is a small gap having the width C shown in FIG. 1. This slight gap between the rotating thread guard 50 and the stationary end cap 90 limits the infiltration of dust into the bearing 80. The outer flange 96 of end cap 90 also has a slight overhang at its inward end, since the flange extends axially inwardly beyond thread guard 50 (and also beyond the end of spindle 20). The axial length of this overhang is denoted by D. This overhang helps to prevent string, threads, and other debris from reaching the bearing 80 through the gap C.

Close tolerances in certain dimensions of the roller assembly 10 of this invention must be observed in order to obtain a roller which is essentially free of vibration and at the same time is capable of rotating freely at the high speeds which are customary in current vacuum cleaner rollers. The term, "tolerance", as used herein has its usual meaning, denoting the maximum permissible difference between an actual dimension of a part and the desired or specified (i.e., nominal) dimension. Deviation in the overall length (the difference between the actual overall length and the desired or nominal overall length) should not exceed ±0.015". The nominal or desired overall length, which is measured from the outer surface of one end plate 91 to the outer surface of the other end plate 91, is the same as the spacing between the two vacuum cleaner chassis members 100 (typically nozzle side walls) in which the roller is mounted. When the actual length of the roller assembly 10 exceeds the desired length by more than about 0.015", pressure is placed on the outer bearing race 84 at each end of the roller, tending to cause the outer race 84 to become axially offset from the inner race 82 by a small amount. This appreciably shortens bearing life. On the other hand, vibration results when the actual roller length is shorter than the desired length, and the extent of vibration becomes unacceptable when the deviation (in this case a negative deviation) is more than about 0.015". The depth of the bore 32 at each end of the spindle 20 should also be close to specification, acceptable deviation being only about ±0.005", as noted earlier. Close tolerance of bore depth is necessary in order to position the stub shafts 70 correctly so that the bearings 80 can be positioned correctly on the respective stub shafts 70 (near the respective outer ends thereof) with the bearings seated on the thread guards 50 at the same time that the inner end of the stub shaft is against the end wall of the bore 32. Concentricity of the stub shafts 70 is also very important. That is, the central axis A of the stub shaft should coincide with the central axis A of the roller 10 as a whole. Only minimal deviations from concentricity, either a slight offset between the shaft axis A and the roller axis A or a slight angle between the shaft axis A and the roller axis A, are acceptable. If the deviation is more than minimal, excessive vibration is likely to be encountered. A major advantage of the roller assembly 10 of this invention that its structure is one which readily lends itself to making rollers having the desired close tolerances. As a result, roller assemblies of this invention have low and acceptable levels of vibration.

The roller assembly 10 shown in FIGS. 1–4 is assembled as follows: First, bearing 80 is assembled on the outboard portion 78 of stub shaft 70 near outer end 72 thereof. The bearing engages the stub shaft via friction fit. Then, all parts are assembled onto the spindle 20 in the order shown in FIG. 2. That is, thread guard 50 is first put in place so that the central web 54 rests against counterbore surface 36 and the outer portion 56 of the thread guard 50 contacts the outer end 22 or 24 of spindle 20. Next, washer 60 is put in place so that it is disposed against the outer surface of central web 54, between central boss 52 and cylindrical side wall 55. Next, stub shaft 70 is inserted into bore 32. Matching of bore diameter and stub shaft diameter and the small tolerances in both assure that the stub shaft 70 will be substantially axially aligned with the central axis A of spindle 20 and bore 32. When stub shaft 70 is inserted, the inner end 71 of stub shaft 70 is against the inner end 33 of bore 32. Also, the roughened middle portion 76 of stub shaft 70 frictionally engages the wall of bore 32, assuring that the spindle 20 and both stub shafts 70 will rotate as a unit. When stub shaft 70 is inserted in place, the inner race 82 of bearing 80 will abut against shoulder 53 of the thread guard 50, thereby retaining the thread guard 50 against the spindle 20 and axially positioning the bearing 80}. Finally, end cap 90 is put in place. When in place, the inside surface of end plate 90 will abut against the outer bearing race 84 of bearing 80 (a portion of the inside surface of end plate 91 is cut away at **91*a* so that end plate 91 will not rub against the rotatable inner race 82 of bearing 80), and flange 94 surrounds and engages the outer wall of bearing 80. Also, the outer flange 96 of end cap 90 will extend beyond the outer end 22 or 24 of spindle 20 as shown in FIG. 1**, affording a gap C and an overhang D as previously mentioned.

Figure 7:
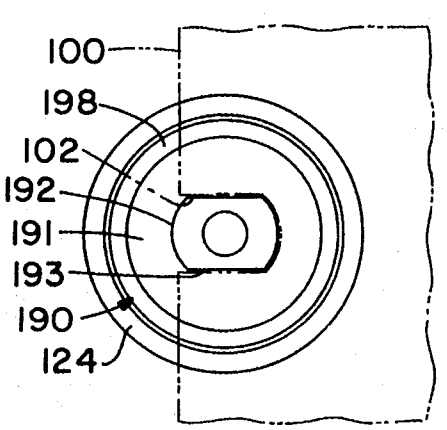
FIG. 7 is an end view of the structure shown in FIG. 5.
Figure 5:
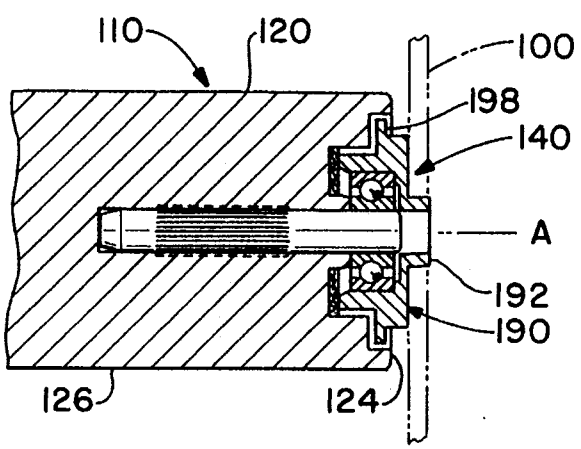
FIG. 5 is a fragmentary longitudinal sectional view of a brush roller assembly according to a second embodiment of this invention.
Figure 3:
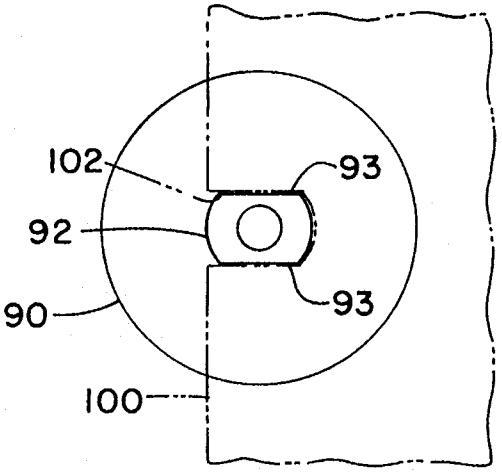
FIG. 3 is an end view of the structure shown in FIG. 1.
Figure 6:
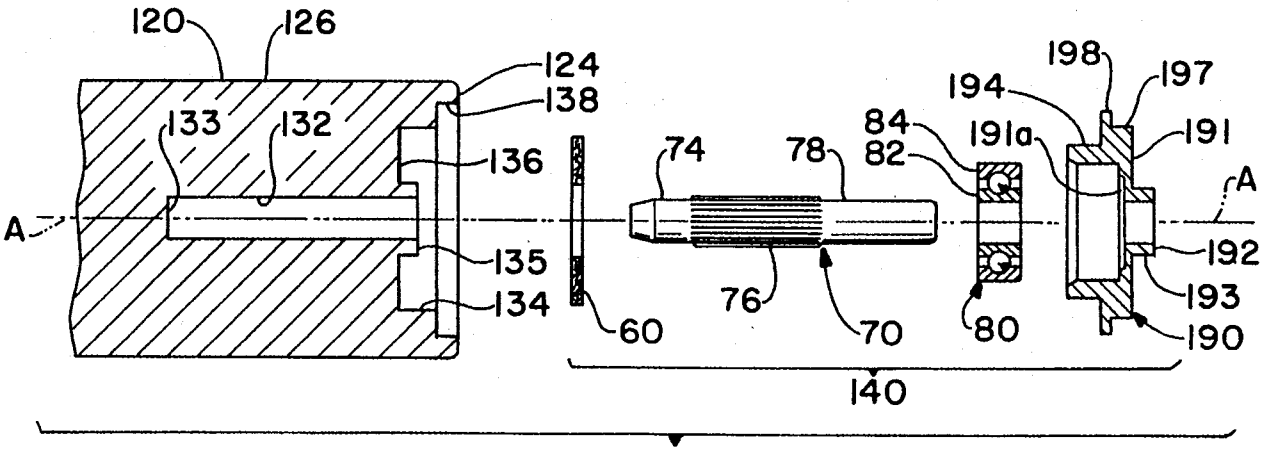
FIG. 6 is an exploded longitudinal sectional view of the structure shown in FIG.

A second embodiment of this invention is shown in FIGS. 5–7.

Referring now to FIGS. 5–7, 110 is a brush roller assembly as a whole according to a second embodiment of this invention. Brush roller assembly 110 comprises an essentially cylindrical spindle 120 having a central axis A, and a pair of end assemblies 140 for rotatably supporting the spindle 120 at opposite ends thereof. There are two end assemblies 140, one at each end of spindle 120. They are preferably identical and so only one is shown in detail. Each end assembly 140 comprises a felt washer 60 (which is optional), a stub shaft 70, and a bearing 80, all of which rotate with spindle 120; and a non-rotating end cap 190, which is adapted to be fixedly mounted in a vacuum cleaner sweeper chassis member 100 (shown in phantom). Typically the vacuum cleaner sweeper chassis members 100 in which the end assemblies 140 are mounted are side walls of a housing for a vacuum cleaner nozzle.

Like parts are designated by like reference numerals throughout the specification. Since washer 60, stub shaft 70, and bearing 80 preferably have the same structure in both embodiments of the invention, the same reference numerals are used throughout. Parts which differ in the two embodiments are denoted by different reference numerals. To the extent practicable, parts in the second embodiment are denoted by reference numerals which are 100 higher than those assigned to the corresponding parts in the first embodiment.

There is no thread guard as such in the second embodiment. However, end cap 190 also serves as a thread spool, as will be described hereinafter in detail.

Spindle 120, like spindle 20, is a solid structure which is preferably made of wood but which can be made of other essentially rigid, hard solid materials, including hard rubber and molded plastic. The spindle 120 can be made of metal (steel, for example) but ordinarily is not metallic for reasons of cost. The spindle should be solid and not hollow.

Spindle 120 is essentially cylindrical and has a central axis A, a first end not shown, a second end 124, and a cylindrical circumferential surface 126 extending from one end to the other. Spindle 120 is motor driven through a drive belt in the same manner as spindle 20 in FIGS. 1–4, and so this aspect of the structure of spindle 120 is not shown. Similarly, a beating or brushing element, typically comprising a plurality of tufted bristles arranged in a helical pattern, may be provided on the cylindrical surface 126 of spindle 120 in the stone manner as has been illustrated in FIG. 1, and so this aspect of spindle 120 is not shown. Extending inwardly along central axis A from each end of spindle 120 is a cylindrical bore 132. Each bore 132 is axially aligned with central axis A. Each bore is closed at its inner end and open at its outer end, and comprises an inner end wall 133 and a cylindrical side wall. Bore 132 receives stub shaft 70. Also extending inwardly tom each end of spindle 120 is an annular first counterbore 134, which is of greater diameter and shorter axial length than bore 132. Counterbore 134 includes a cylindrical inner wall of slightly greater diameter than that of bore 132 so as to form a shoulder 135, a cylindrical outer side wall, and a flat annular inner end wall surface 136 which extends between the inner and outer side walls. The outer end of counterbore 134 is open. The shoulder 135 provides an abutment for properly positioning a bearing 80. Counterbore 134 provides a recess for washer 60 (when used) and for an axially inwardly extending flange (to be described in detail later) of end cap 190.

Spindle 120 further comprises at each end a second counterbore 138, which is of greater diameter and smaller axial length than those of the first counterbore 134. The diameter of second counterbore 138 is only slightly less than that of spindle 120. The second counterbore provides a recess for a radially extending flange portion (to be described in detail later) of end cap 190.

There are two end assemblies 140, one at each end of spindle 120. They are preferably identical and so only one is shown in detail. Each end assembly comprises a felt washer 60 (which is optional) and a stub shaft 70, both of which rotate with spindle 120; a bearing 80, and a non-rotating end cap 190, which is adapted to be fixedly mounted in a vacuum cleaner chassis member 100 (shown in phantom). Typically the vacuum cleaner sweeper chassis member 100 in which the end assemblies 140 are mounted comprises spaced side walls of a housing for a vacuum cleaner nozzle.

As in the embodiment of FIGS. 1–4, the roller assembly 110 of the second embodiment may be mounted in a conventional upright vacuum cleaner sweeper suitable for home use. The overall length of the brush roller assembly 110 is determined by the spacing between the vacuum cleaner chassis members (such as nozzle housing side walls) in which the assembly 110 is mounted.

The structures of washer 60 and stub shaft 70 are preferably the same as in the embodiment of FIGS. 1–4, and so the description of these parts will not be repeated. As in the first embodiment, the diameter of the smooth portions 74 and 78 of stub shaft 70 is very slightly less than the diameter of bore 132, just enough less to permit insertion of the stub shaft while guiding the stub shaft so that it is essentially axially aligned with the spindle 120. Also as in the first embodiment, the diameter of the roughened center portion 76 of stub shaft 70 is just slightly larger than the diameter of bore 132, so that when the stub shall is inserted into position with its inner end against the end wall 133 of bore 132, the stub shaft will frictionally engage the side wall of bore 132 so that each stub shaft 70 and the spindle 120 will rotate as a unit.

The non-rotating (or stationary) end cap 190 comprises a flat annular end plate 191 which has a central opening and an outer circumferential edge, both of which are circular in shape. End plate 191 has inner and outer surfaces (unnumbered); a portion of the inner surface is cut away at 191*a* so that the end cap 190 (which does not rotate) will not rub against the rotatable inner race 82 of bearing 80. The central opening (which is not essential) may have the same diameter as that of the outboard portion 78 of stub shaft 70. Surrounding the central opening is an axially outwardly directed boss 192, which includes a pair of opposite flat sides 193, which are adapted to puctionally engage a slot 102 in the vacuum cleaner chassis members (e.g., nozzle side walls) 100. Boss 192 and its flat sides 193 are structurally and functionally similar to their respective counterparts 92 and 93 in the first embodiment.

End cap 190 further comprises an annular flange 194, which extends axially inwardly from end plate 191. The purpose of flange 194 is to provide a well or receptacle for receiving the bearing 80. To this end the inner diameter of flange 194 is essentially the same as the outer diameter of bearing 80. The axial length of the flange 194 is preferably just slightly longer than the axial length of bearing 80. Flange 194 has an annular forward edge which loosely bears against washer 60 (but is spaced from the annular flat surface 136 of counterbore 134 when washer 60 is omitted) as shown in FIG. 5.

End cap 190 further comprises a cylindrical spool portion 197 at the outer circumferential edge of end plate 191, and a flange 198 which extends radially outwardly from spool portion 197 and axially directed flange 194. This radially directed flange 198 is disposed in a recess formed by the second counterbore 138 of spindle 120, so that the stationary end plate 190 does not come into contact with the rotating spindle 120. The spool 197 and the flange 198 together serve as a thread guard which helps to prevent debris such as threads, strings, etc., from reaching the bearing 80. Threads, strings, etc., that find their way to the ends of the spindle 120 are wrapped around the spool 197 so that they do not reach the bearing.

Tolerances in the second embodiment are the same as in the first embodiment.

The roller assembly 110 of the second embodiment is assembled in a manner similar to assembly of the roller assembly 10 of the first embodiment. The bearing 80 is friction fitted on the outboard section 78 of stub shaft 70 near the outer end 72, in the manner previously described. Then components are assembled in the order shown in FIG. 6. First, washer 60 is placed in the annular recess formed by counterbore 134, so that the washer is against the flat surface 136. Next, preassembly of stub shaft 70 and bearing 80 is inserted into bore 132. The inboard portion 74 of the stub shaft 70 is inserted into the bore 132 and the preassembly is moved axially until the inner end 71 of the stub shaft is in contact with the end wall 133 of bore 132. Simultaneously, bearing 80 comes into contact with shoulder 135. The roughened portion 76 of stub shaft 70 grips the side wall of bore 132 so that spindle 120 and the stub shafts 70 at each end rotate as a unit. Also, the shoulder 135 supports bearing 80 and stabilizes it against lateral movement perpendicular to central axis A. Finally, end cap 190 is put in place so that the inner surface of end wall 191 is against the non-rotating outer race 84 (but not against the rotating inner race 82) of bearing 80. The inside wall of flange 194 is in frictional engagement with the outer wall of bearing 80. The forward edge of flange 194 lightly touches washer 60. The end cap 190 is so dimensioned that there are clearances between the spindle and the facing surfaces of the end cap 190, i.e., the outer wall of flange 194 and the facing flat surface and outer circumferential surface of flange 198. Finally, the completed assembly 110 may be installed in a vacuum cleaner chassis, such as the two opposite side walls of a vacuum cleaner nozzle housing 100, in the same manner as has been described with reference to the first embodiment.

Both embodiments of this invention provide roller assembly structures which are easily manufactured to close dimensional tolerances and a high degree of concentricity.

This invention has been described in detail with reference to specific embodiments thereof for the purpose of illustration and not limitation. Many variations and modifications will be apparent to those skilled in the art from the above detailed description. Therefore, variations and modifications within the scope of the appended claims can be made without departing from the scope and spirit of this invention.

What is claimed is:

1. A brush roller assembly comprising an essentially rigid and essentially cylindrical spindle having a central axis and a pair of co-axial end assemblies for rotatably supporting said spindle at opposite ends thereof, wherein:

(a) said spindle has opposite first and second ends and a cylindrical, circumferential surface extending between said ends and further includes an axial bore of predetermined depth extending inwardly from each end, each of said bores having a closed inner end and an open outer end and comprising a cylindrical side wall and a transverse end wall at said inner end;

(b) said brush roller assembly further includes an annular shoulder surrounding the open outer end of each of said bores, said shoulders each being adapted to receive and position a bearing;

(c) each of said end assemblies comprises:

(1) an essentially cylindrical, shoulderless stub shaft of essentially uniform diameter over its entire length, said stub shaft comprising a smooth, cylindrical inboard portion which is received in a respective one of said bores, a roughened middle portion which frictionally grips that bore so that said shaft and said spindle rotate together, and a smooth, cylindrical outboard portion which extends axially outwardly beyond that bore, said stub shaft having a first end which abuts the inner end of said bore;

(2) a bearing mounted on the outboard portion of said shaft; and (3) an end cap comprising a radially extending end plate having inner and outer surfaces and a flange extending axially inwardly therefrom and surrounding said bearing, said end cap being adapted to be fixedly mounted on a chassis member of a vacuum cleaner sweeper;

each said bearing being in abutting relationship with a respective one of said shoulders and a respective one of said end plates.

2. A brush roller assembly according to claim 1 wherein said spindle further includes an axial counterbore extending inwardly from each end, each of the counterbores forming a recess for its associated bearing and flange.

3. A brush roller assembly according to claim 2, further including a felt washer disposed in each of the recesses formed by said counterbores.

4. A brush roller assembly according to claim 2, wherein each said end assembly further includes a thread guard in contact with a respective end of said spindle and rotatable with said spindle, said thread guards each comprising an annular flat central web having a central opening for a respective stub shaft, and a flat annular outer portion axially offset from said central web, said central web being in engagement with a flat inner end surface of a respective counterbore and said outer portion being in engagement with the respective end of said spindle, said outer portion having a circular outer circumference which extends radially beyond the circumferential surface of said spindle, forming a lip for preventing threads from reaching the associated bearing.

5. A brush roller assembly according to claim 4 in which each said thread guard further comprises an axially outwardly directed boss surrounding said central opening, said boss terminating in said shoulder.

6. A brush roller assembly according to claim 4 in which each said end cap further includes a second flange which extends axially inwardly from the outer circumference at the outer portion thereof, said second flange extending beyond said lip and the respective end of said spindle.

7. A brush roller assembly according to claim 2 in which each of said shoulders is formed on said spindle at the outer end of a respective one of said bores.

8. A brush roller assembly according to claim 1 wherein each of said bearings has a rotatable inner race and a stationary outer race, each inner race being in abutting relationship with a respective one of said shoulders and each outer race being in abutting relationship with a respective one of said end plates.

9. A brush roller assembly according to claim 8, wherein each of said bearings is a ball bearing.

10. A brush roller assembly according to claim 1, in which the difference between actual depth and said predetermined depth of each said axial bore does not exceed ±0.005" and the difference between actual overall length and desired overall length of said brush roller assembly does not exceed ±0.015".

11. A brush roller assembly comprising an essentially rigid and essentially cylindrical spindle having a central axis and a pair of co-axial end assemblies for rotatably supporting said spindle at opposite ends thereof, wherein:

(a) said spindle has opposite first and second ends and a cylindrical circumferential surface extending between said ends and further includes an axial bore of predetermined depth extending inwardly from each end, each of said bores having a closed inner end and an open outer end, and comprising a cylindrical side wall and a transverse end wall at said inner end;

(b) said brush roller assembly further includes an annular shoulder surrounding the open outer end of each of said bores, said shoulders each being formed on said spindle at the outer end of a respective one of said bores and being adapted to receive and position a bearing;

(c) each of said end assemblies comprises:

(1) an essentially shoulderless stub shaft of essentially uniform diameter over its entire length, said stub shaft comprising a smooth, cylindrical inboard portion which is received in a respective one of said bores, a roughened middle portion which frictionally grips that bore so that said shaft and said spindle rotate together, and a smooth, cylindrical outboard portion which extends axially outwardly beyond that bore, said stub shaft having a first end which abuts the inner end of said bore;

(2) a bearing mounted on the outboard portion of said shaft; and (3) an end cap comprising a radially extending end plate having inner and outer surfaces and a flange extending axially inwardly therefrom and surrounding said bearing, said end cap being adapted to be fixedly mounted on a chassis member of a vacuum cleaner sweeper; and wherein further:

(d) the spindle further includes an axial counterbore extending inwardly from each end, each of the counterbores forming a recess for its associated bearing and flange, and a second counterbore at each end of said spindle, each of said second counterbores being of greater diameter and less axial depth than each aforementioned counterbore, each of said second counterbores forming a recess for a respective one of said end caps; and (e) each said end plate has a circular outer circumference and each said end cap further comprises a cylindrical wall at the outer circumference of the respective end plate, and a radially extending flange which extends radially outwardly from said cylindrical wall, said cylindrical wall forming a spool for threads and said radially extending flange forming a thread guard.

* * * * *